US006067461A

United States Patent [19]

Ye et al.

[11] Patent Number: 6,067,461

[45] Date of Patent: May 23, 2000

[54] STRIPLINE COUPLING STRUCTURE FOR HIGH POWER HTS FILTERS OF THE SPLIT RESONATOR TYPE

[75] Inventors: Shen Ye, Cambridge; Raafat R. Mansour, Waterloo, both of Canada

[73] Assignee: Com Dev Ltd., Cambridge, Canada

[21] Appl. No.: 08/758,471

[22] Filed: Nov. 29, 1996

Related U.S. Application Data

[60] Provisional application No. 60/025,895, Sep. 13, 1996.

[51] Int. Cl.[7] ..... H01P 1/203; H01B 12/02

[52] U.S. Cl. ..... 505/210; 505/700; 505/701; 505/866; 333/204; 333/99 S

[58] Field of Search ..... 333/202, 204, 333/205, 219, 260, 99 S; 505/210, 700, 701, 706, 866

[56] References Cited

U.S. PATENT DOCUMENTS

| | | | |
|---|---|---|---|
| 3,605,045 | 9/1971 | Ramsbotham, Jr. | 333/204 |
| 5,461,352 | 10/1995 | Noguchi et al. | 333/204 |
| 5,543,386 | 8/1996 | Findikoglu et al. | 333/99 S X |

FOREIGN PATENT DOCUMENTS

| | | | |
|---|---|---|---|
| 678562 | 8/1979 | U.S.S.R. | 333/204 |
| 1283877 | 1/1987 | U.S.S.R. | 333/204 |
| 1450017 | 1/1989 | U.S.S.R. | 333/202 |

*Primary Examiner*—Benny T. Lee
*Attorney, Agent, or Firm*—Daryl W. Schnurr

[57] ABSTRACT

A microwave filter has a plurality of resonators and at least one transmission line mounted on a substrate having a ground plane. The filter can have input and output couplings that are transmission lines formed on the substrate or it can have input and output probes. The resonators have one or more gaps extending entirely therethrough, the gaps splitting the resonators into two or more slices. The transmission lines extend into the gap to couple energy into or out of a resonator or between two adjacent resonators. The transmission lines can have tapered ends or can be located off center so that they are closer to one side of a gap than to another side.

26 Claims, 11 Drawing Sheets

PRIOR ART

STRIPLINE COUPLING STRUCTURE FOR HIGH POWER HTS FILTERS OF THE SPLIT RESONATOR TYPE

This application claims benefit of Provisional Application 60,025,895 filed Sep. 13, 1996.

BACKGROUND OF THE INVENTION

1. Field of the Invention

This invention relates to microwave filters and, more particularly, to coupling mechanisms between transmission lines and resonators to provide improved power handling capability for microstrip/stripline type bandpass filters that are realized using high temperature superconductive materials. Further, this invention relates to a new coupling mechanism between input/output lines and resonators and between two adjacent resonators.

When resonators and transmission lines are referred to in this application, they can be either microstrip or stripline resonators and transmission lines.

2. Description of the Prior Art

Typical microstrip bandpass filters consist of input/output couplings, or I/O couplings and resonators where an I/O coupling consists of a feed line and an interface structure that provides a path from the feed line to the filter resonators. I/O couplings are also referred to as input/output terminations. An I/O coupling may be in the form of direct contact or gap coupled. FIGS. 1 to 3 show examples of microstrip bandpass filters with different I/O coupling types (see K. Chang, "Handbook of Microwave and Optical Components, Vol 1: Microwave Passive and Antenna Components", John Wiley & Sons, 1989). Conventional gap I/O coupling is either parallel-coupled or end-coupled, as shown in FIG. 2 and FIG. 3, respectively. Parallel coupled structure realizes coupling at one side of the resonator. It is suitable for long and narrow shaped resonator structures. To overcome the limitation of the feed line width which is determined by feed line impedance, a T-shaped end-coupling structure can be used, as shown in FIG. 4.

In high power applications using HTS thin film technology, wider resonators can be used to lower current density. The current density can be further reduced using sliced resonators (see co-pending U.S. patent application Ser. No. 08/595,864, now U.S. Pat. No. 5,922,650, issued Jul. 13, 1999), as shown in FIG. 5. However, to obtain desired I/O coupling, the end coupling structure described in the co-pending application requires a very small gap, which can cause arcing. Further, T-shaped end coupling structures (as shown in FIG. 4) can contain bend discontinuities where high current concentration exists.

SUMMARY OF THE INVENTION

It is an object of the present invention to provide a microwave filter where resonators contain gaps into which transmission lines are inserted.

A microwave filter has transmission lines and a resonator mounted on a substrate, the substrate having a ground plane. The resonator has a gap therein. Each of the transmission lines has two ends. The transmission lines are smooth with no sharp bends. One end of one transmission line extends into said resonator within the gap but spaced apart from the resonator. One of the transmission lines is an input coupling and another of the transmission lines is an output coupling.

A microwave filter has an input probe and an output probe and a resonator mounted on a substrate, the substrate having a ground plane. The resonator has a gap therein, the gap extending entirely through the resonator to create a split resonator. The input probe extends into the resonator above the gap and the output probe extends into the resonator above the gap. The probes are axial line probes.

A microwave filter has an input probe and an output probe and a plurality of resonators mounted on a substrate, the substrate having a ground plane. There is a first resonator and a last resonator, each resonator having a gap therein. The input probe extends into the first resonator above the gap and the output probe extends into the last resonator above the gap. The probes are axial line probes.

DESCRIPTION OF A PREFERRED EMBODIMENT

Figure 6:
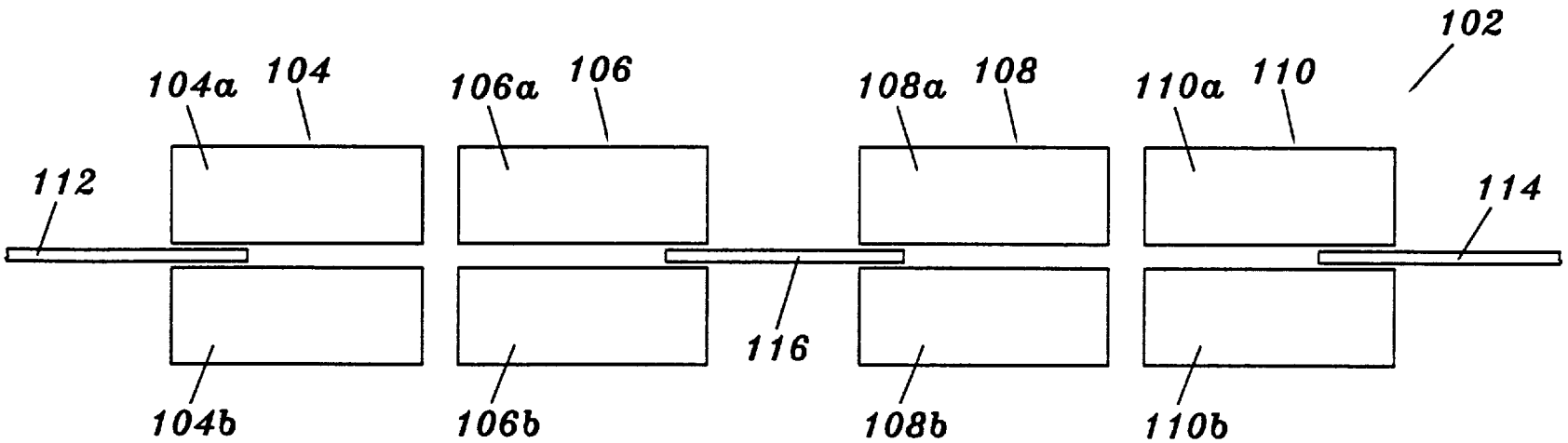
FIG. 6 is a schematic top view of a four-pole filter with couplings used for input and output as well as for cascading two resonators.

A resonator which is interfaced by an I/O coupling can be of a sliced resonator type. The feed line is inserted into the resonator in one of resonator gaps as shown in FIG. 6. By adjusting the depth of penetration and spacing between the feed line and resonator, a wide range of coupling values can be achieved. Since it is a smooth line configuration, no high current concentration exists due to discontinuities. The possibility of arcing is significantly reduced because of much wider spacing between the inserted line and resonator than with previous devices.

Figure 1:
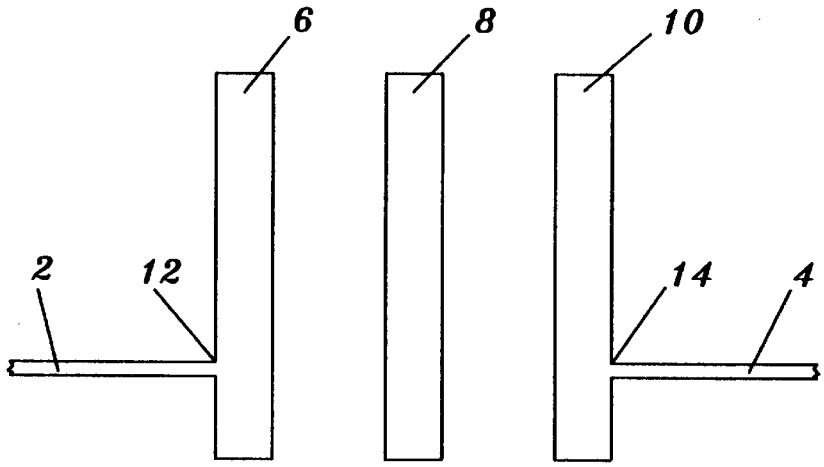
Figure 1 PRIOR ART
FIG. 1 is a schematic top view of a prior art microstrip filter having direct contact I/O couplings.

In FIG. 1, a prior art microstrip filter has feed lines 2, 4. There are three resonators 6, 8 and 10. Feed line 2 is in direct contact at point 12 to resonator 6. Feed line 4 is in direct contact at point 14 to resonator 10.

Figure 2:
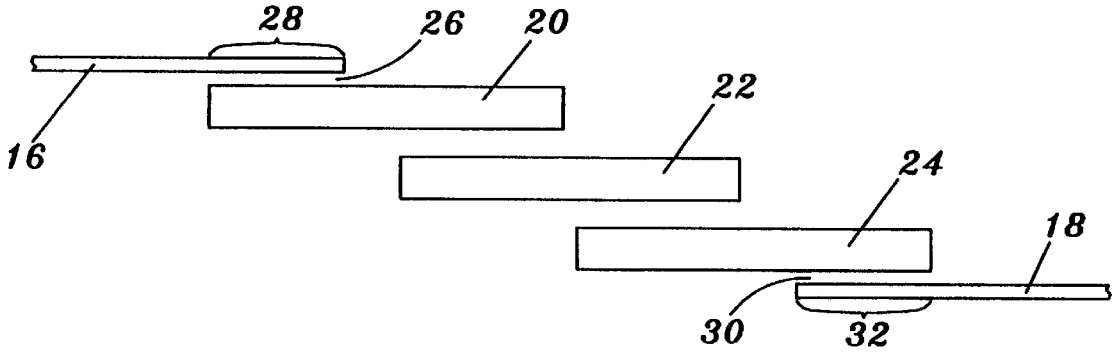
FIG. 2 is a schematic top view of a prior art microstrip filter where I/O coupling is in the form of a parallel section between the feed line and the resonator separated by a gap.

In FIG. 2, a prior art microstrip filter is shown with feed lines 16, 18 and resonators 20, 22 and 24. A gap 26 separates parallel section 28 of the feed line 16 from the resonator 20. Similarly, a gap 30 separates parallel section 32 of the feed line 18 from the resonator 24.

Figure 3:
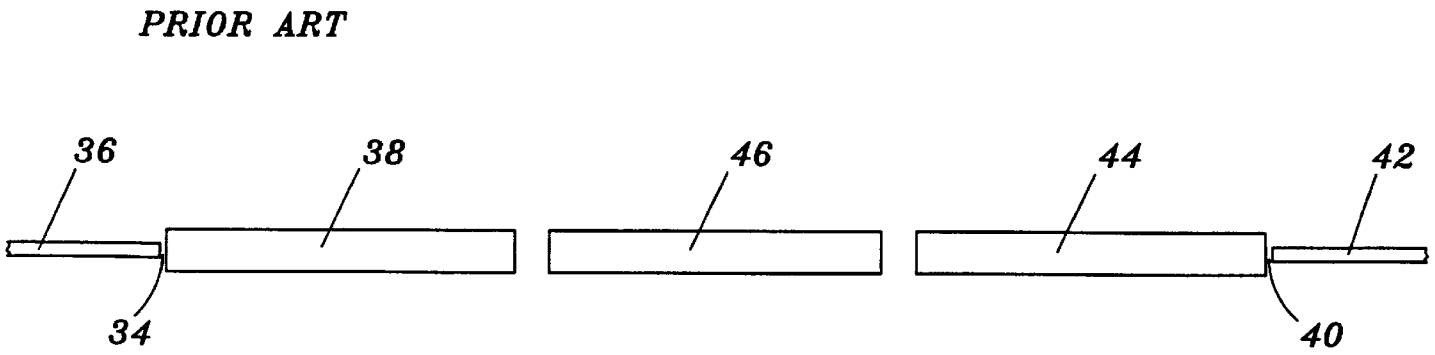
FIG. 3 is a schematic top view of a prior art microstrip filter where I/O coupling is accomplished by feed line end gaps.

FIG. 3 shows a prior art end-coupled microstrip filter. A gap 34 separates the right end of feed line 36 and the left end of a resonator 38. Similarly, a gap 40 separates the left end of feed line 42 and the right end of resonator 44. Resonator 46 is part of the filter and is located between resonators 38 and 44. The smaller the gaps 34, 40, the larger the I/O coupling.

Figure 4:
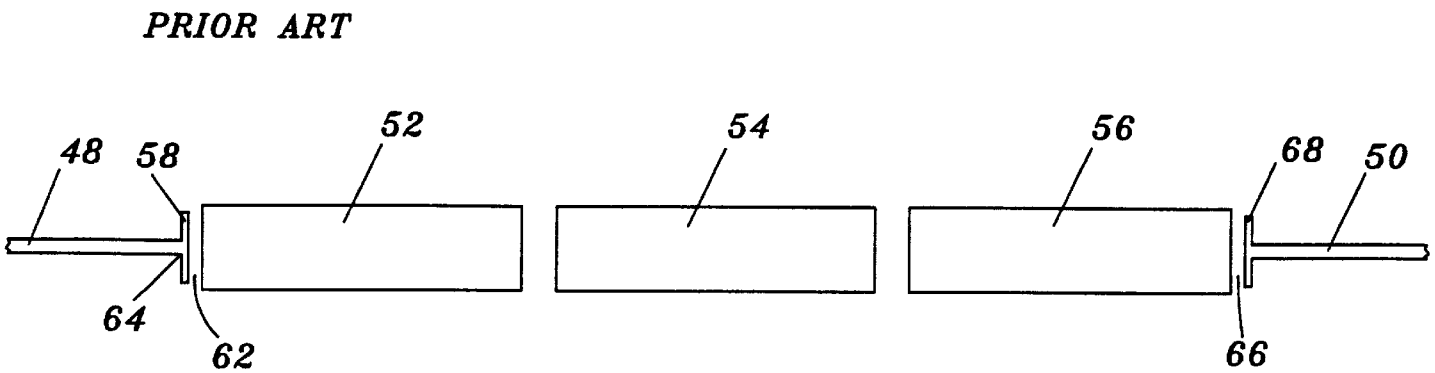
FIG. 4 is a schematic top view of a prior art microstrip filter where T-shaped end coupling structure is used.

In FIG. 4, a prior art microstrip filter is shown with T-shaped end gap coupling structures to provide better coupling range and control. The filter has feed lines 48, 50 and resonators 52, 54 and 56. At the left end of feed line 48, a thin strip 58 extends perpendicularly to form a T-shape with the feed line and to increase the interface edge facing resonator 52, which is separated by gap 62. The amount of I/O coupling is controlled by the length and width of strip 58 and spacing of gap 62. High current concentration exists at bend corner 64. The relationship between resonator 56, gap 66, strip 68 and feed line 50 are similar to the resonator 52, gap 62, strip 58 and feed line 48 respectively.

Figure 5:
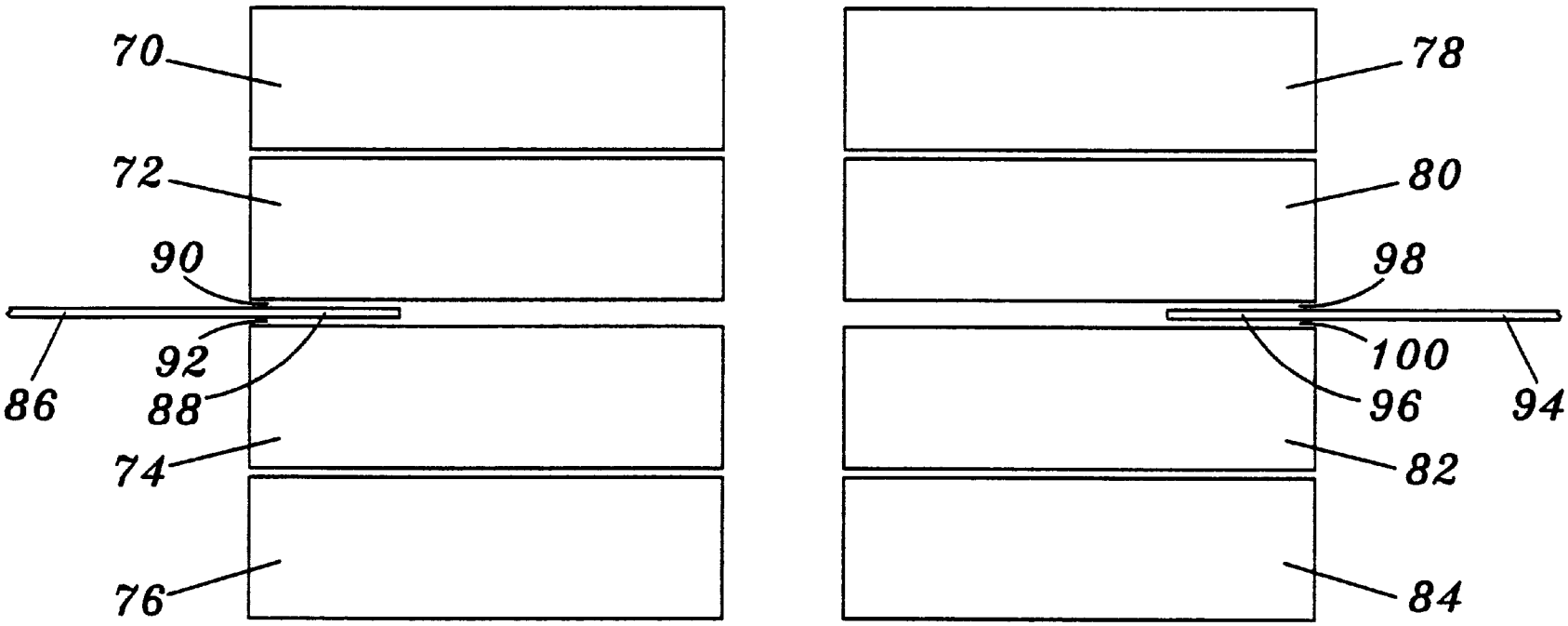
FIG. 5 is a schematic top view of a two pole microstrip filter having two sliced resonators with I/O coupling achieved by smooth lines extended into the resonators.

In FIG. 5, a microstrip filter of the present invention is shown with gap-separated inserted line I/O coupling structures. Each resonator in this filter is sliced into a number of strips to reduce current over the edge. The first resonator consists of strips 70, 72, 74 and 76 and the second resonator consists of strips 78, 80, 82 and 84. Feed line 86 has an end portion 88 which is located between strips 72, 74 of the first resonator. The end portion 88 is separated from the first resonator by gaps 90, 92. Similarly, feed line 94 has an end portion 96 that extends between strips 80, 82 and is separated from said strips 80, 82 by gaps 98, 100. Compared with the I/O coupling structure shown in FIG. 3, this novel inserted line structure provides a wide range of coupling values without requiring very small gaps when larger couplings are required. In contrast to the T-shaped coupling structure shown in FIG. 4, the inserted line structure of FIG. 5 is smooth and contains no bends. Therefore, there are no high current density spots or areas which typically exist at the inner corner of a bend.

FIG. 6 shows a four-pole filter 102 consisting of four resonators 104, 106, 108 and 110. The resonators 104 and 110 are a first and last resonator respectively. Resonators 106, 108 are interior resonators. Each resonator is respectively divided into two strips. Resonators 104, 106, 108 and 110 are sliced respectively into strips 104*a* and 104*b*, 106*a* and 106*b*, 108*a* and 108*b*, 110*a* and 110*b*. I/O lines 112, 114 are inserted between the strips 104*a*, 104*b*, 110*a* and 110*b* respectively to provide the necessary I/O coupling to the filter. Resonators 106, 108 are connected by transmission line 116. Transmission line 116 has two ends, one end is inserted into a gap of the resonator 106 and the other end is inserted into a gap of the resonator 108. The line 116 is similar to the I/O lines 112, 114 and provides cascade couplings between resonators 106 and 108.

Figure 7:
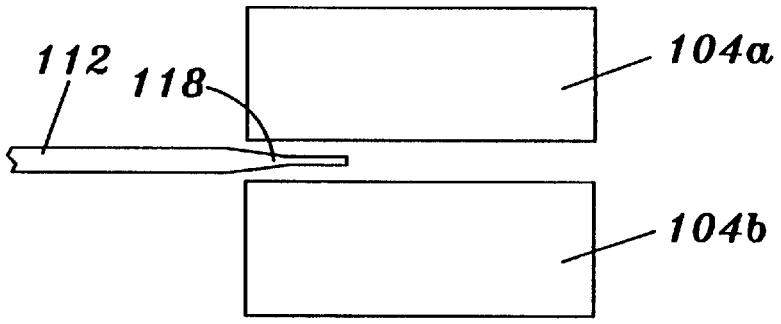
FIG. 7 is a schematic top view of an I/O line and a resonator where the line has a tapered end.

FIG. 7 is a schematic view showing a mechanism to couple the input line 112 to the two strips 104*a*, 104*b* of the input resonator where the input line is tapered at an inner end 118 to reduce current density and/or to adjust the coupling value.

Figure 8:
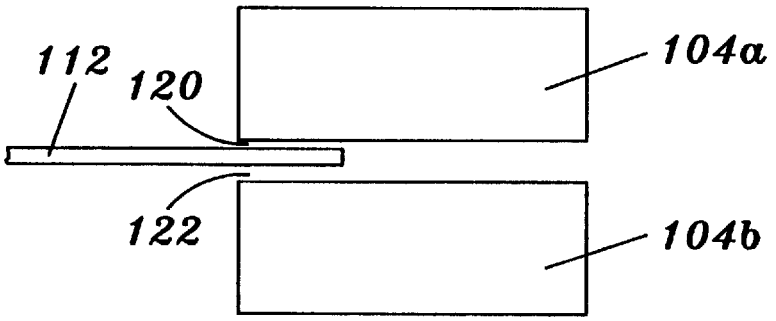
FIG. 8 is a schematic top view of an I/O line and a resonator where the gaps on either side of the line are of different sizes.

FIG. 8 is a schematic view showing a mechanism to couple the input line 112 to the two strips 104*a*, 104*b* of the input resonator where the input line is offset from the resonator center so that a gap 120 between the line 112 and the strip 104*a* is smaller than a gap 122 between the line 112 and the strip 104*b*.

Figure 9:
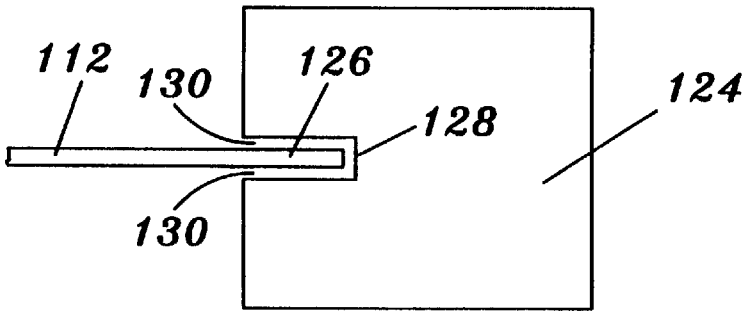
FIG. 9 is a further embodiment of an I/O line and a resonator containing a recess for receiving the line.

FIG. 9 is a schematic view showing a further embodiment of a mechanism to couple the input line 112 to an input resonator 124 where an inner end portion 126 of the line 112 is located within a recess 128 and separated from said recess by gaps 130.

Figure 10:
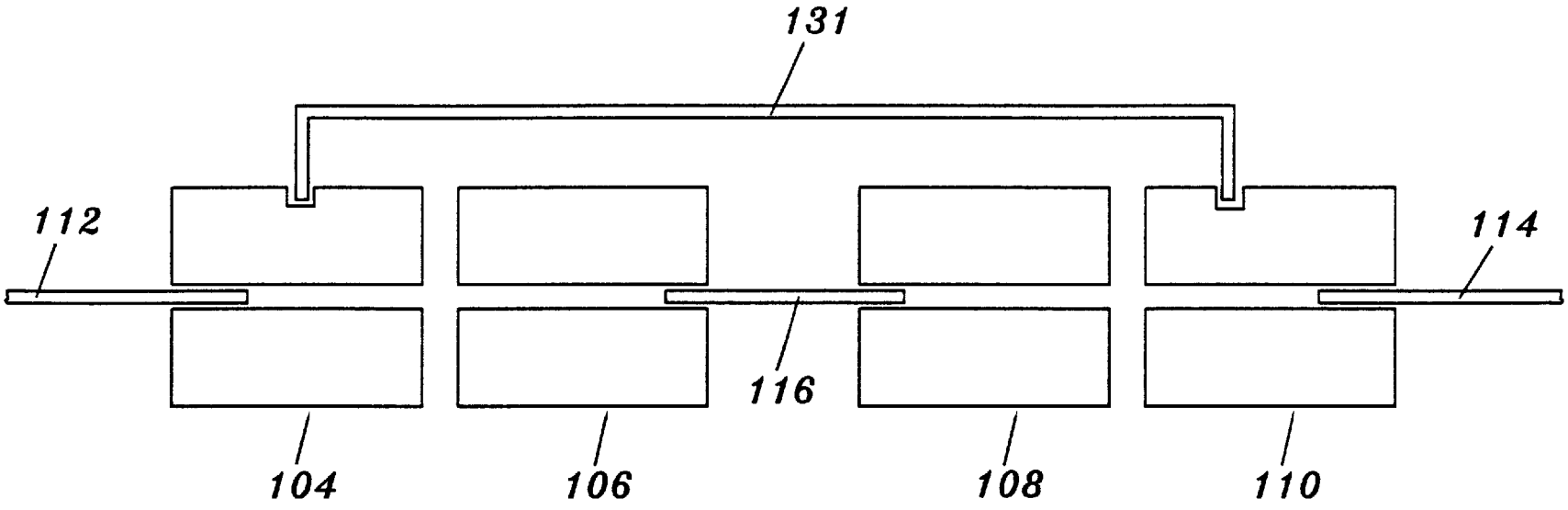
FIG. 10 is a four-pole elliptic function filter where coupling between a first and fourth resonator is implemented using a coupling mechanism shown in FIG. 9.

FIG. 10 illustrates a four-pole filter similar to the one shown in FIG. 6 where a line 131 is used to provide coupling between resonators 104 and 110. The same reference numerals are used in FIG. 10 for those components that are the same as the components of FIG. 6 without specifically referring to those reference numerals in the description of FIG. 10.

Figure 11:
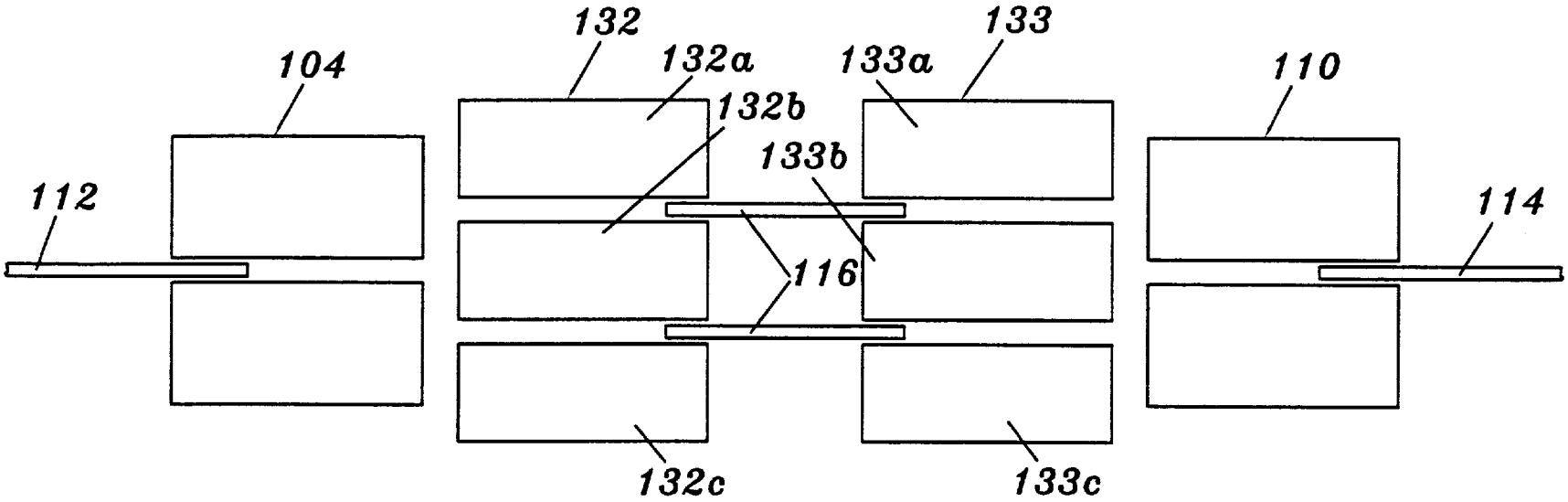
FIG. 11 is a schematic view of a four-pole filter that is similar to the filter of FIG. 6 except that two interior resonators having three sections and two gaps.

FIG. 11 is a schematic view showing a four-pole filter and is a variation of the filter shown in FIG. 6. Resonators 132, 133 are each divided into three slices 132*a*, 132*b*, 132*c* and 133*a*, 133*b* and 133*c* respectively. Resonators 132, 133 each have two gaps extending entirely through said resonators. Two transmission lines 116 each have two ends. One end extends into one gap of resonator 132 and another end extends into a corresponding gap of 133. In this way, the transmission lines 116 provide cascade coupling between resonators 132 and 133. The same reference numerals have been used to describe those components of the filter shown in FIG. 11 that are identical to those of the filter shown in FIG. 6, without specifically referring to those reference numerals in the description of FIG. 11.

Figure 12:
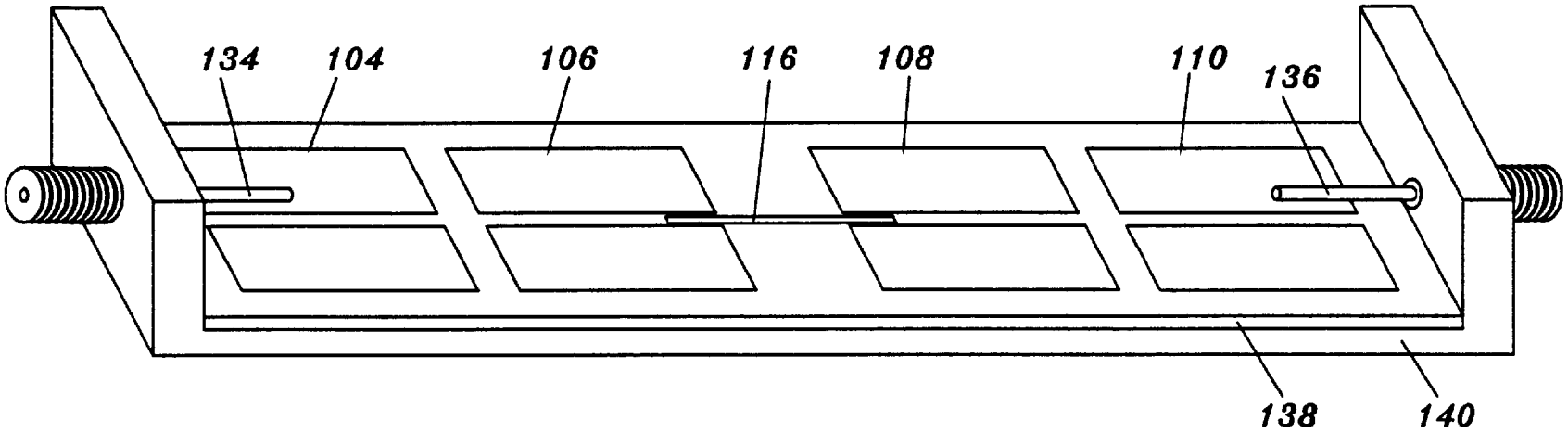
FIG. 12 is a perspective view of a four-pole filter similar to the filter shown in FIG. 6 except that I/O coupling is realized by probes.
Figure 13:
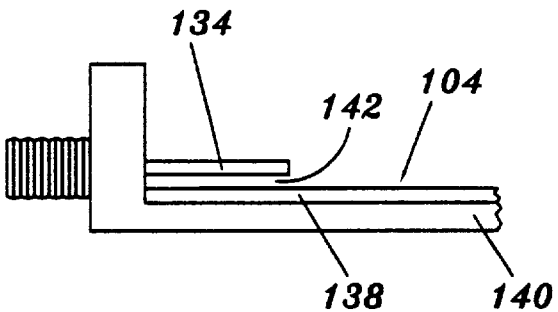
FIG. 13 is a partial side view of one end of the filter of FIG. 12.

FIG. 12 is a perspective view showing a four-pole filter similar to the filter shown in FIG. 6 except that microstrip I/O lines 112 and 114 in FIG. 6 are replaced by I/O probes 134 and 136. FIG. 13 is a partial side view of the filter shown in FIG. 12. Substrate 138 is mounted on metal carrier 140. The probe 134, mounted on the carrier 140, extends into the resonator 104 and is suspended above substrate 138. There is a space 142 between probe 134 and substrate 138. The coupling between the probe 134 and resonator 104 is determined by a size of the space 142 and the extension length. Probe 136 is similar to probe 134 (see FIG. 12). Replacing I/O microstrip lines with probes improves the power handling capability of the filter I/O structure and also provides flexibility to adjust I/O couplings. Those components of FIG. 12 that are identical to the filter of FIG. 6 have been described using the same reference numerals, without specifically referring to those reference numerals in the description of FIG. 12.

Figure 14:
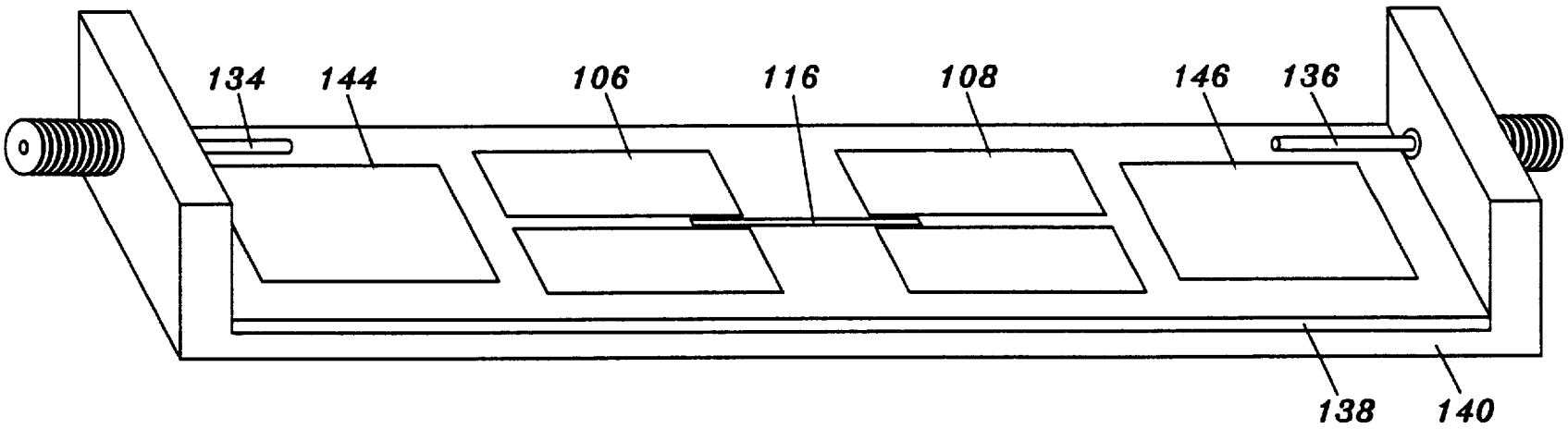
FIG. 14 is a perspective view of a four-pole filter similar to the filter shown in FIG. 12 except that first and last resonators do not contain a gap.

FIG. 14 is a perspective view of a four-pole filter that is similar to the filter shown in FIG. 12 except that first and last resonators 104, 110 of the filter shown in FIG. 12 have been replaced with first and last resonators 144, 146 respectively. The resonators 144, 146 are not split resonators and do not contain a gap. The probes 134, 136 extend into the resonators 144, 146 respectively and are located above these resonators. The same reference numerals have been used to describe those components of the filter shown in FIG. 14 that are identical to components of the filter described in FIG. 12, without specifically referring to those reference numerals in the description of FIG. 14.

Figure 15:
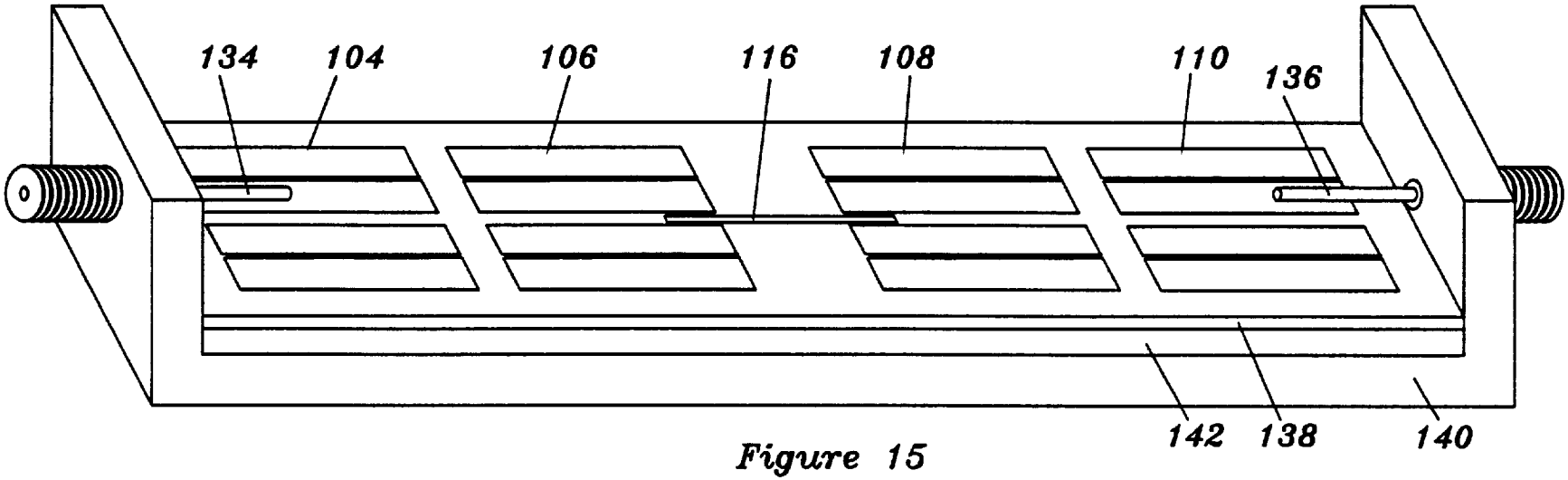
FIG. 15 is a perspective view of a suspended stripline filter.
Figure 16:
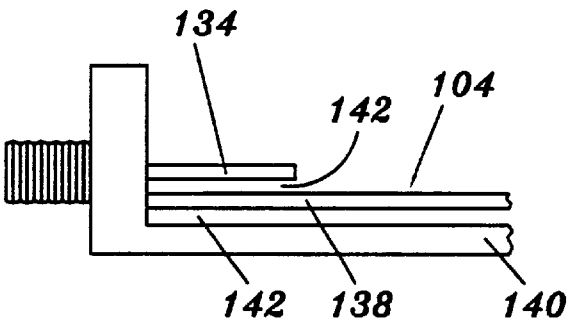
FIG. 16 is a partial side view of the filter of FIG. 15.

In FIG. 15, a filter has four split resonators 104, 106, 108, 110 with an input 134 and an output 136. A transmission line 116 extends within a gap in the resonators 106, 108. As seen in FIGS. 15 and 16, substrate 138 is suspended above a metal carrier 140 and separated therefrom by an air space 142. The input 134 and output 136 are also separated from the resonators 104, 110 respectively by a space 142.

Figure 17:
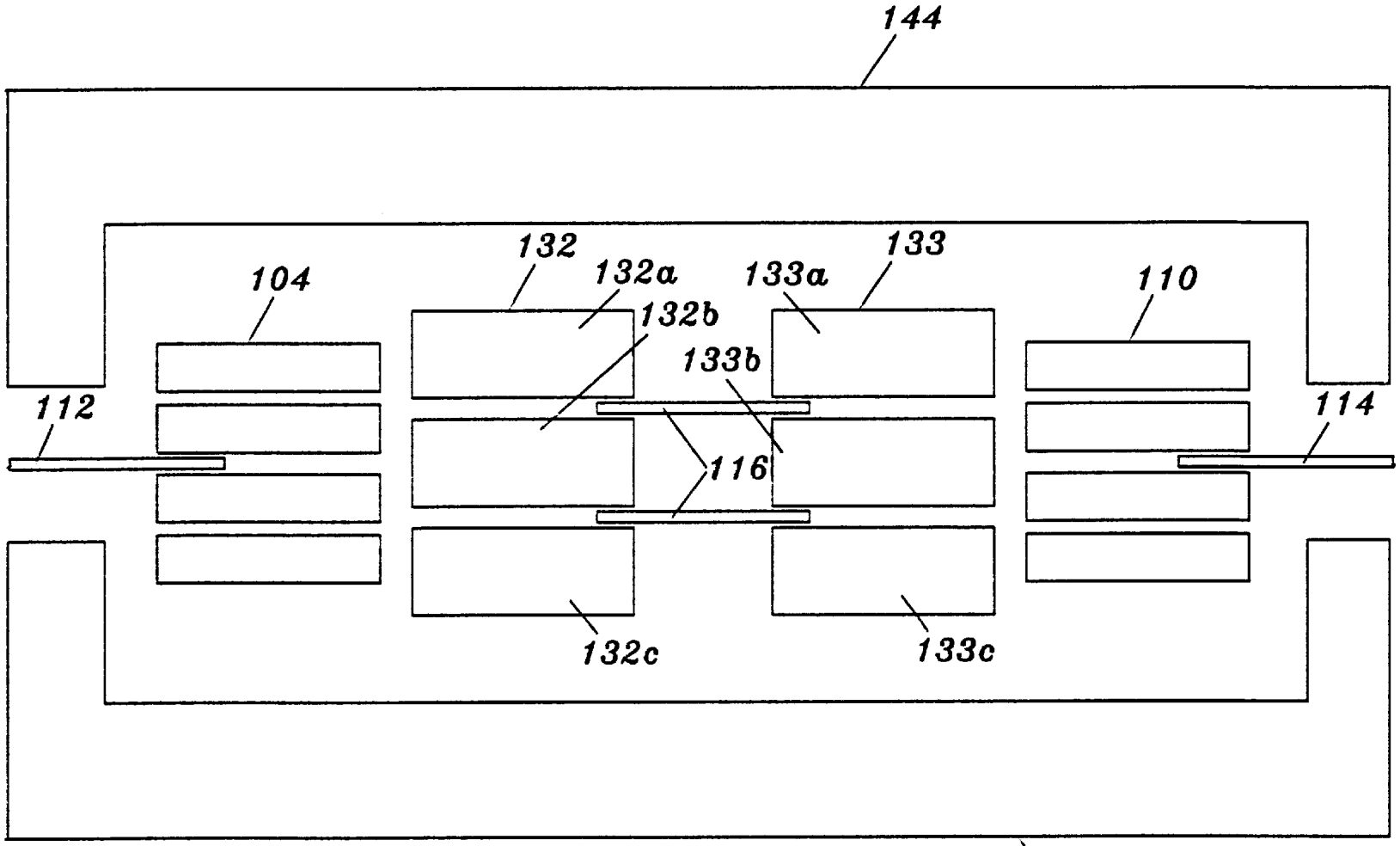
FIG. 17 is a top view of a coplanar filter.

In FIG. 17, a coplanar filter has a circuit that is similar to the circuit of FIG. 11 or a combination of FIG. 11 and FIG. 15 except that a ground plane 144 is located on either side of the circuit. The circuit has split resonators 104, 132, 133, 110 with an input 112 and an output 114. Transmission lines 116 extend in a gap between the split resonators 132 and 133. There are two transmission lines 116. One transmission line 116 extends between the gaps between slices 132*a*, 132*b* and 133*a*, 133*b* respectively. The other transmission line 116 extends between the gaps in slices 132*b*, 132*c* and 133*b*, 133*c* respectively.

The filters of the present invention can be made of various materials. For example, the transmission lines and resonators can be made of high temperature superconductive material or gold film. Further, the resonators and transmission lines can be made of gold film on high temperature superconductive material. Also, one of these materials could be used for one or more components of a filter and another of these materials could be used for other components of the filter. For example, the resonators of a filter could be made from high temperature superconductive material and the input and output transmission lines could be made from gold film on high temperature superconductive material.

There are numerous variations that can be made with respect to the present invention of a line inserted into a resonator to obtain the desired I/O coupling. For example, the inserted portion of the line can have a different width from the rest of the feed line or can be a tapered line. Further, the inserted portion of the line can be identical to the rest of the feed line and have an even width. The gaps between the line and the resonator can be of different sizes so that the gap on one side of the line is smaller than the gap on another side of the line. Also, the gaps themselves do not need to be of uniform width. The amount of coupling is adjusted by gap spacings and length of the inserted portion of the feed line. The coupling technique is not limited to input/output couplings but can also be used to cascade resonators. The filter structures can be in microstrip, stripline, suspended stripline, coplanar line or any other format of planar filters. The transmission lines and resonators are preferably made out of high temperature superconductive material but can also be made out of gold, copper or other known metallic films or any combination of these materials. When the word "microstrip" is used in this specification, it is deemed to include and to be interchangeable with "stripline". As a further variation, when filter structures use curved resonators, the I/O feed line is also curved. Further variations within the scope of the invention described will be readily apparent to those skilled in the art.

We claim:

1. A microwave filter comprising transmission lines and at least one resonator mounted on a substrate, said substrate having a ground plane, said at least one resonator having at least one gap therein that extends entirely through said at least one resonator to provide a split resonator with two slices, each of said transmission lines having two ends, said transmission lines being smooth with no sharp bends along a length thereof, one end of one of said transmission lines extending into said at least one resonator within said at last one gap but spaced apart from said two slices of said at least one resonator, said filter having an input coupling and an output coupling, wherein at least one of said transmission lines and said resonators comprised of high temperature superconductive material.

2. A microwave filter comprising an input probe, an output probe and a resonator mounted on a substrate, said substrate having a ground plane, said resonator having a gap therein, said gap extending entirely through said resonator to provide a split resonator, said input probe extending into said resonator above said gap, said output probe extending into said resonator above said gap, said input and output probes being axial line probes, said input and output probes having a respective coaxial line arrangement and said input and output probes being an extension of a respective center conductor of said corresponding arrangement.

3. A filter as claimed in claim 1 wherein one of said transmission lines is an input coupling and another of said transmission lines is an output coupling, said at least one resonator including a plurality of resonators, there being a first resonator and a last resonator of said plurality of resonators, said first and last resonators each having a respective gap therein, one end of said input coupling extending into said respective gap of said corresponding first resonator, one end of said output coupling extending into said respective gap of said corresponding last resonator of said plurality of resonators.

4. A filter as claimed in claim 2 wherein said probes are smooth with no sharp bends along a length thereof.

5. A filter as claimed in claim 3 wherein said at least one gap includes a respective gap which extends through each of said resonators, thereby providing split resonators.

6. A filter as claimed in any one of claims 1, 3 or 5 wherein one end of said one of said transmission lines extending into said at least one gap has a tapered portion.

7. A filter as claimed in any one of claims 1, 3 or 5 wherein one end of said one of said transmission lines extending into said at least one gap is located closer to one side of said at least one gap than to another side of said at least one gap.

8. A filter as claimed in claim 5 wherein said first and last resonators are each split into at least four respective slices, each of said first and last resonators therefore containing at least three respective gaps.

9. A filter as claimed in claim 5 wherein said filter is a four-pole filter with said plurality of resonators having four resonators including said first resonator, said last resonator and two interior resonators, all of said resonators being split resonators, each resonator having at least two respective slices therein, an interior transmission line of said transmission lines extending between said interior resonators and extending into said respective gap of each resonator of said corresponding interior resonators to couple microwave energy between said interior resonators, said first and last resonators each containing a second respective gap therein to receive an exterior transmission line of said transmission lines, one end of said exterior transmission line extending into said second respective gap of said first corresponding resonator and another end of said exterior transmission line extending into said second respective gap of said last corresponding resonator.

10. A filter as claimed in claim 5 wherein said filter is a four-pole filter with said plurality of resonators having four resonators, there being two interior resonators in addition to said first and last resonators, said interior resonators each having two respective gaps therein that extend entirely through said corresponding resonators to provide split resonators having three slices therein with two transmission lines of said transmission lines extending between said two interior resonators, one transmission line of said two transmission lines extending within the first respective gaps of said two corresponding interior resonators and another transmission line of said two interior transmission lines extending within the second respective gaps of said corresponding interior resonators.

11. A filter as claimed in claim 1 wherein said at least one resonator includes a plurality of resonators, said filter being a four-pole filter with said plurality of resonators having four resonators including a first resonator, a last resonator and two interior resonators, each of said resonators containing a respective gap extending entirely through said corresponding resonator to provide a split resonator having two respective slices, one interior transmission line of said transmission lines extending from within the respective gap of one corresponding interior resonator to within the respective gap of another corresponding interior resonator to couple microwave energy between said interior resonators, an input probe extending into said first resonator, said input probe providing said input coupling.

12. A filter as claimed in claim 11 wherein the last resonator has an output probe extending into said respective gap of said corresponding last resonator, said output probe providing said output coupling.

13. A filter as claimed in claim 1 wherein said at least one resonator includes a plurality of resonators, said filter being a four-pole filter with said plurality of resonators having four resonators including two interior resonators, each of said interior resonators containing a respective gap extending entirely through said corresponding resonators to provide split interior resonators with two respective slices, an interior transmission line of said transmission lines extending from within the respective gap of one corresponding interior resonator to within the respective gap of another corresponding interior resonator to couple microwave energy between said interior resonators, an input probe extending into said first resonator, said input probe providing said input coupling.

14. A filter as claimed in claim 1 wherein said at least one resonator includes four resonators, there being a first resonator and a last resonator and two interior resonators, said first and last resonators not having a gap, an input probe extending into said first resonator and an output probe extending into said last resonator, at least one of said two interior resonators having a respective gap, said input and output probes providing said input and output couplings respectively.

15. A filter as claimed in any one of claims 1, 4 or 5 wherein any transmission lines and any resonators of said filters are comprised of a material selected from the group of high temperature superconductive material, gold film and gold film on high temperature superconductive material.

16. A filter as claimed in any one of claims 8, 9 or 10 wherein any transmission lines and any resonators of said filters are comprised of a material selected from the group of high temperature superconductive material, gold film and gold film on high temperature superconductive material.

17. A filter as claimed in claim 12 wherein each of said input and output probes extends above one of said respective gaps in a corresponding resonator.

18. A filter as claimed in claim 17 wherein said input and output probes extend directly above said respective gaps in said corresponding first and last resonators.

19. A microwave filter as claimed in claim 1 wherein one, of said transmission lines is an input coupling and another of said transmission lines is an output coupling, said at least one resonator having two gaps, one gap receiving one end of said input coupling and another gap of said two gaps receiving one end of said output coupling.

20. A filter as claimed in claim 2 where in said input probe and said output probe extend directly above said gap in said resonator.

21. A microwave filter comprising an input probe and an output probe and a plurality of resonators, there being a first resonator and a last resonator of said plurality of resonators, said first and last resonators each having a respective gap therein extending entirely through said corresponding resonators, said input probe extending into said corresponding first resonator above said respective gap, said output probe extending into said corresponding last resonator above said respective gap, said input and output probes being axial line probes, said input and output probes having a respective coaxial line arrangement and said input and output probes being an extension of a respective center conductor of said corresponding arrangement.

22. A filter as claimed in claim 21 wherein every resonator has a respective gap, said respective gap providing corresponding split resonators and said input and output probes being located directly above said respective gap in said first and last resonators.

23. A filter as claimed in claim 22 wherein said plurality of resonators include interior resonators in addition to said first and last resonators, said interior resonators each having a respective gap therein with an interior transmission line having two ends, one end thereof extending into a respective gap of one corresponding interior resonator and another end thereof extending into a respective gap of another corresponding interior resonator, said interior transmission line coupling energy between said two interior resonators.

24. A filter as claimed in any one of claims 17, 2 or 21 wherein any resonators and any transmission lines of said transmission lines are comprised of a material selected from the group of high temperature superconductive material, gold film and gold film and high temperature superconductive material.

25. A filter as claimed in any one of claims 1, 3 or 4 wherein each gap, including said at least one gap, has a uniform width.

26. A filter as claimed in any one of claims 1, 3 or 5 wherein the filter is comprised of a configuration selected from the group of microstrip, stripline, suspended stripline and coplanar line.

* * * * *